US009534482B2

(12) United States Patent
Schneider et al.

(10) Patent No.: US 9,534,482 B2
(45) Date of Patent: Jan. 3, 2017

(54) THERMAL MOBILIZATION OF HEAVY HYDROCARBON DEPOSITS

(71) Applicant: R.I.I. NORTH AMERICA INC., Calgary (CA)

(72) Inventors: Fred Schneider, Calgary (CA); Greg Kuran, Calgary (CA); Lynn Tessier, Eckville (CA)

(73) Assignee: R.I.I. NORTH AMERICA INC., Calgary (CA)

( * ) Notice: Subject to any disclaimer, the term of this patent is extended or adjusted under 35 U.S.C. 154(b) by 399 days.

(21) Appl. No.: 14/103,366

(22) Filed: Dec. 11, 2013

(65) Prior Publication Data

US 2014/0096961 A1 Apr. 10, 2014

Related U.S. Application Data

(62) Division of application No. 13/103,876, filed on May 9, 2011, now abandoned.

(60) Provisional application No. 61/333,645, filed on May 11, 2010, provisional application No. 61/356,416, filed on Jun. 18, 2010, provisional application No. 61/421,481, filed on Dec. 9, 2010.

(51) Int. Cl.
*E21B 43/24* (2006.01)
*E21B 43/16* (2006.01)

(52) U.S. Cl.
CPC ..... *E21B 43/24* (2013.01); *E21B 43/164* (2013.01); *E21B 43/166* (2013.01); *E21B 43/2406* (2013.01); *E21B 43/2408* (2013.01)

(58) Field of Classification Search
CPC ..... E21B 43/164; E21B 43/166; E21B 43/24; E21B 43/2406; E21B 43/2408
See application file for complete search history.

(56) References Cited

U.S. PATENT DOCUMENTS 3,147,804 A * 9/1964 Wyllie ..... E21B 43/247 166/257
3,159,215 A * 12/1964 Meldau ..... E21B 43/243 166/258

(Continued)

FOREIGN PATENT DOCUMENTS

CA 2015459 * 8/1995 ..... E21B 43/24

*Primary Examiner* — Nicole Coy
(74) *Attorney, Agent, or Firm* — Parlee McLaws LLP; Sean Goodwin

(57) ABSTRACT

A method is provided for applying a thermal process to a lower zone underlying an overlying hydrocarbon zone with thermal energy from the thermal process mobilizing oil in the overlying zone. The lower zone itself could be a hydrocarbon zone undergoing thermal EOR. Further, one can economically apply a thermal EOR process to an oil formation of low mobility and having an underlying zone such as a basal water zone. Introduction gas and steam, the gas having a higher density than the steam, into the underlying zone displaces the basal water and creates an insulating layer of gas between the steam and the basal water maximizing heat transfer upwardly and mobilizing viscous oil greatly reducing the heat loss to the basal water, economically enhancing production from thin oil bearing zones with underlying basal water which are not otherwise economic by other known EOR processes.

12 Claims, 6 Drawing Sheets

(56) References Cited

U.S. PATENT DOCUMENTS

| | | | | | |
|---|---|---|---|---|---|
| 3,167,120 | A * | 1/1965 | Pryor | E21B 43/24 | 166/269 |
| 4,124,071 | A | 11/1978 | Allen et al. | | |
| 4,489,783 | A | 12/1984 | Shu | | |
| 5,456,315 | A * | 10/1995 | Kisman | E21B 43/305 | 166/245 |
| 6,050,335 | A * | 4/2000 | Parsons | E21B 43/305 | 166/263 |
| 7,934,549 | B2 * | 5/2011 | Cimolai | E21B 43/24 | 166/258 |
| 8,327,936 | B2 * | 12/2012 | Coskuner | C10G 1/047 | 166/272.3 |
| 2013/0118737 | A1 * | 5/2013 | Schneider | E21B 43/2406 | 166/272.3 |
| 2014/0251596 | A1 * | 9/2014 | Gittins | E21B 43/2406 | 166/248 |

* cited by examiner

THERMAL MOBILIZATION OF HEAVY HYDROCARBON DEPOSITS

CROSS-REFERENCE TO RELATED APPLICATIONS

This application claims the benefits under 35 U.S.C. 120 of the U.S. patent application Ser. No. 13/103,876, filed May 9, 2011, and published as US 2011/0278001 on Nov. 17, 2011, which claims the benefits under 35 U.S.C 119(e) of U.S. Provisional Application No. 61/333,645, filed May 11, 2010, U.S. Provisional Application No. 61/356,416, filed Jun. 18, 2010, and U.S. Provisional Application No. 61/421,481, filed Dec. 9, 2010, which are all incorporated fully herein by reference.

FIELD

The present invention relates to a method for effectively directing thermal energy into a heavy hydrocarbon zone overlying a lower zone. More particularly steam, gas or combinations thereof are introduced to the lower zone for contact and thermal heat transfer upward and for stimulation of the overlying heavy hydrocarbons. In one embodiment the lower zone is a water zone, introduced gas being used to drive water radially away from a point of introduction and injected steam riding over the heavier injected gas. Injected steam condenses and gravity drains downward while the associated non-condensable gas accumulates around the point of introduction, creating an insulating layer between the thermal energy and the surrounding heat sinks or thief zones. The result is that heat rises into the overlying heat sink, lessening thermal losses to the underlying water zone. The gas and the steam can be formed in-situ by a downhole burner. In another embodiment, the lower zone is a hydrocarbon zone, steam being used both for lower zone stimulation and for thermal heat transfer upward to the overlying hydrocarbon zone.

BACKGROUND

It is known to conduct enhanced oil recovery (EOR) of hydrocarbons from subterranean hydrocarbon-bearing formations after primary recovery processes are no longer feasible. Viscous, heavy oil, including bituminous deposits, can be too deep for surface recovery and in-situ methodologies are employed.

Thermal methods include such as in-situ combustion and steam flood, which use various arrangements of stimulation or injection wells and production wells. In some techniques the injection and production wells may serve both duties. Other techniques include cyclic steam stimulation (CSS), in-situ combustion and steam assisted gravity drainage (SAGD). SAGD uses closely coupled generally parallel wells, a horizontally-extending steam injection well forming a steam chamber for mobilizing heavy oil for recovery at a substantially parallel and horizontally-extending production well. Thermal in-situ approaches are typically applied for oilsands which are heavy and viscous, having a gravity of 8-10° API and viscosities ranging from 10,000 to 300,000 cp. Non-thermal approaches include Cold Heavy Oil Production with Sand (CHOPS) in which sand is co-produced with the heavy oil, the oil typically having viscosities in the range of 500 to 15000 cp. In Alberta, the Energy Resources Conservation Board (ERCB) has deemed or classified heavy oils by gravity as an ERCB Crude Oil Density (See directive 17 http://www.ercb.ca/docs/documents/directives/

Directive017.pdf, as of October 2009, "crude bitumen wells and heavy oil wells density of 920 kilograms per cubic meter [kg/m3] or greater at 15° C."). This specific gravity of about 0.92 is equivalent to about 22.3 API or heavier, while bitumen having a specific gravity of about 1.0 has an API gravity of about 10.

Where a heavy oil formation overlies a water zone, where the water forms a base of the formation, typically known as a basal water zone, in-situ techniques become more limited, in part due to the huge thermal heat sink of the water zone. One recovery approach which incorporated the water zone in the recovery was implemented by Shell Canada Limited and the Alberta Oilsands Technology and Research Authority (AOSTRA) in the late 1970's and 1980's in the Peace River leases of Alberta Canada. The approach was termed the pressure-cycle steam drive (PCSD). The PCSD utilized steam injection to heat the basal water zone underlying the oilsand. Once communication was established between wells, continuous steam injection was begun, with the injection and production rates controlled to alternately pressure up and blow down the reservoir (see Alberta Oil Sands Technology and Research Authority, *AOSTRA Technical Handbook on Oil Sands, Bitumens and Heavy Oils. Edmonton,* 1989). Shell Canada Limited set forth a historical review of resource recovery alternatives in their 2009 application to the Energy Resources Conservation Board (ERCB) of Alberta, CANADA, Carmon Creek Project. Reviewing their own PCSD concept, Shell stated: "steam is injected into the bottom water zone (the lowest 4 m to 6 m of the 25 m-thick reservoir) at high injection rates and pressures. Production rates at producers would vary between periods of low and high rates. This caused cycles of high reservoir pressure during low production rates and low reservoir pressure during high production rates. Expectations were that steam would be forced into the upper parts of the reservoir, and bitumen would be produced by gravity drainage. These expectations were not met during the large-scale development stage, and recovery was found to be uneconomic."

Applicant understands that CSS techniques were subsequently employed to continue exploitation of this resource. CSS in this circumstance is still associated with difficulties. Typically, an upper injection well, for injecting steam and forming a steam chamber for mobilizing oil, and a lower producer well would have been provided for collecting heated, mobilized oil. The producer well is located about 5 m above the base of the oilsand formation and the injector well another about 5 m above the producer well. The location of the producer well, being about 5 m above the base, is known to be an arrangement to avoid or delay breakthrough from a thief zone or basal water zone. This also results in lost potential to exploit this lower 5 m of what might only be a 15 to 25 m thick zone. This and other thin payzones are still greatly underexploited.

Applicant believes the expense of surface steam production, only to be lost to the large heat sink of the water zone, contributed to the discontinuance of this methodology.

Another well known issue with underlying water zones is the tendency for water coning. The water, being more mobile, preferentially migrates to the production well to the exclusion of the oil resource.

Further, in thermal EOR, heat transfer to overburden has conventionally been an unfortunate energy loss.

Applicant believes that in-situ processes to date have not successfully accommodated due to energy losses and compromised as a result of underlying water. Further, some formations have had stimulation limited to cold production, such as heavy oil in unconsolidated sand, which can be situated in payzones too narrow for SAGD.

Improved techniques are required which recover more of the resource and with favourable economics.

SUMMARY

In one embodiment, a method of thermal EOR for subterranean formation is provided comprising introducing thermal energy to a lower zone which underlies a first oil formation in an upper zone. Thermal energy, travelling upwardly through the lower zone, heats this first oil formation from below. The heated oil become mobilized for ready production from the upper zone.

In another embodiment, the lower zone might be isolated from the upper zone by a substantially impermeable layer, such as a caprock or shale layer. Accordingly, the thermal energy travels to the upper zone by conduction, and production from the upper zone is conventional or implements a drive to assist in the production of the mobilized oil.

In another embodiment, the lower zone itself is a second oil formation isolated from the upper, first oil formation. The thermal energy received by the upper zone can be heat lost to the overburden from a thermal EOR being conducted in the lower zone.

A variety of known methodologies can be employed for introducing thermal energy into the lower zone including SAGD arrangements, steam injection, in-situ steam generation and downhole burners.

In another embodiment, a method of thermal EOR is provided comprising introducing gas and steam to a lower zone containing basal water, both of which underlie an oil formation in an upper zone. The heavier gas and lighter steam gravity separate to stratify, forming an insulating layer of gas below a steam layer. Accordingly, the steam is insulated from the substantially infinite heat sink of the basal water wherein the steam transfers a predominate fraction of its thermal energy upwardly to the oil formation thereabove. As above, the thermal energy heats the oil, reducing its viscosity, and mobilizing the oil for production. Where the lower zone is in communication with the upper zone, the steam also serves to drive the mobilized oil to one or more production wells spaced laterally from the location of introduction of the steam. Basal water in the lower zone is progressively driven radially outward, forming a bowl-like interface or inverted cone, exposing ever greater areas of the upper zone to thermal energy. As the steam condenses, the greater density of the condensed water causes it to percolate down through the gas layer to the underlying basal water. In an embodiment, the one or more production wells are completed within the oil formation. In another embodiment, one or more of the temperature, viscosity, or gas is monitored for detection of, location of, or extent of oil mobilization and the one or more production wells are correspondingly completed within the oil formation where the oil has been mobilized. The production wells can be re-completed at different elevations as the mobilization conditions change.

In another embodiment, one or both of the first or second oil formations are heavy oil formations. In another embodiment, the oil formations are oilsand formations. In another embodiment, oil formation is an oilsand formation too thin for conventional exploitation using SAGD. In another embodiment, and as a source of thermal energy, gas and steam are introduced into the lower zone from the operation of a downhole burner. In another embodiment, the downhole burner produces high temperature, hot $CO_2$ gas, and steam is created by the interaction of the hot gas and water, the water being selected from in-situ basal water or injected water.

DETAILED DESCRIPTION

Figure 1:
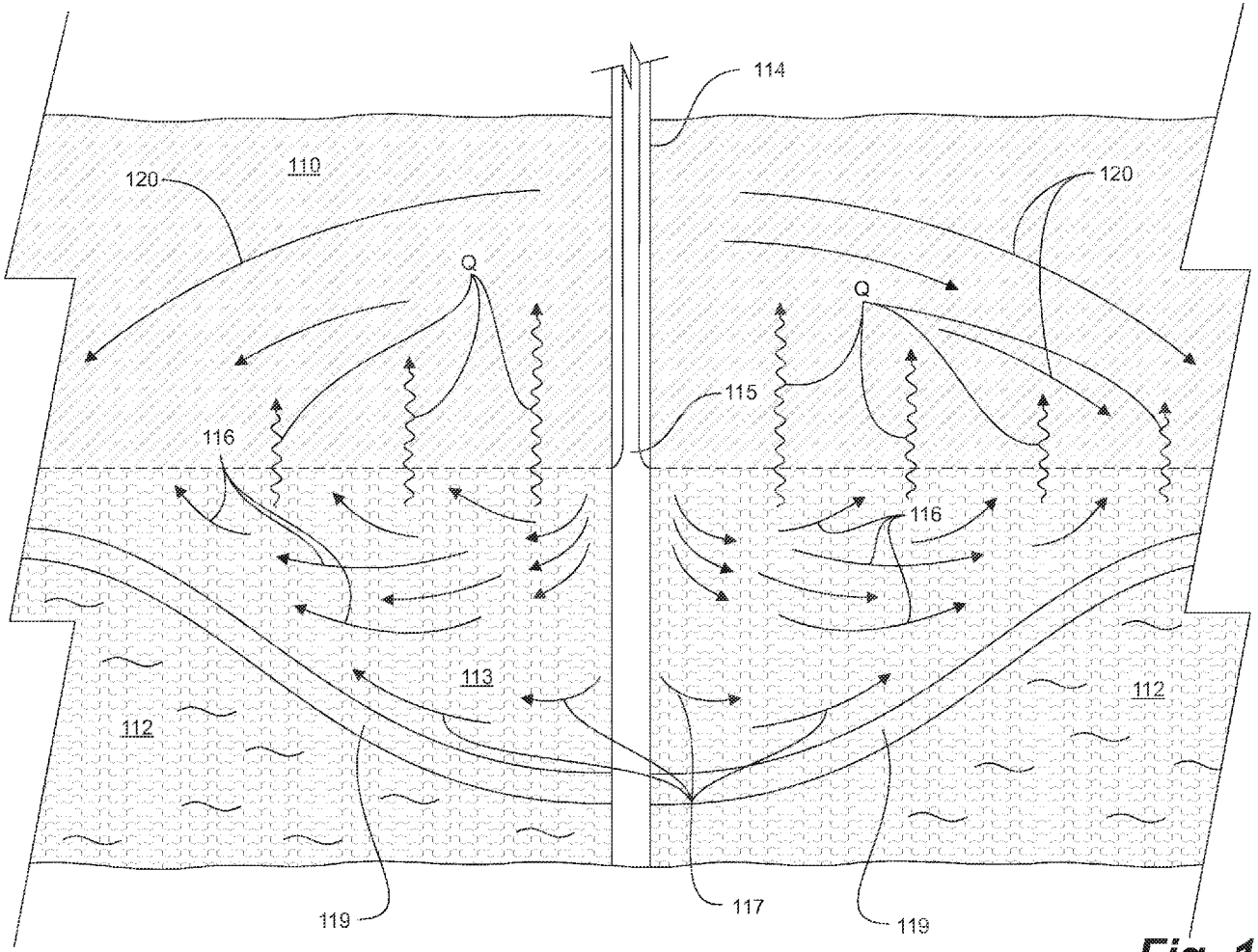
FIG. 1 is a schematic of a thermal injection well completed in a lower water zone according to a first embodiment.

In a broad embodiment, heat of thermal energy is introduced to a lower zone for delivering heat to an overlying upper zone having at least a first oil formation which benefits from a heated formation, including heavy oil suitable for enhanced oil recovery (EOR). The lower zone can be underburden, even including a water or basal zone, or can be another zone undergoing EOR.

In one embodiment, this first oil formation is a heavy oil zone unsuitable for SAGD for one reason or another, including being too narrow or shallow to accommodate parallel injection and production wells, can benefit from thermal stimulation as disclosed therein. One such form of formation is one produced using Cold Heavy Oil Production with Sand or CHOPS. In conventional CHOPS, oil is co-produced with formation sand with the formation of "wormholes" in the sand formation which allows more oil to reach the production wells. As Applicant understands the mechanism, a low pressure area is created near the production wells, typically using progressive cavity pumps. Solution gas phase changes into a vapour, fluidizes oil and sand that flows into the low pressure area and is produced. In Alberta, Canada, co-production of sand, wormholes and fluidization produces between 3% to 8% of the original oil in place. Further, Applicant believes the existence of wormholes, prevalent in an upper portion of the formation, can contraindicate use of steam enhanced recovery as the wormholes can preferentially channel steam away from target oil.

However, Applicant notes that introducing an additional factor, by creating a foamy oil drive by increasing the temperature by a few degrees, is heretofore unknown in CHOPS production. Herein, a Stimulated Foamy Oil Drive (SFOD) is applicable to virgin or depleted fields with appropriate reservoir conditions. The process can enhance and extend the life of wormhole development. The SFOD process stimulates the first oil formation by subjecting the target reservoir to heat from below, which is received from the underburden or lower zone. This creates a generally linear contiguous temperature increase within the overlying target formation which enhances solution gas release from the liquid oil/water phase. Any source delivering thermal energy to the bottom of the reservoir underburden will facilitate the process. Solution gas is stimulated to disassociate from the fluid state by raising the temperature, enhancing the original drive and recovery mechanisms to a predominant temperature drive. Herein, if a thermal EOR project is already implemented in a lower zone, waste heat will drive the process in the upper zone.

As the overlying heavy oil reservoir responds to the thermal propagation, a foamy oil drive is created which flows through a network of worm-holes into a gathering system of production wells. As voidage is created, and the network of high permeability channels (wormholes) expands, breakthrough occurs which creates a network. Over time, production shifts to a free flowing gravity drain exploitation. The wormhole network grows as the process mobilizes oil, creating voidage which provides a route for bypassed virgin oil to flow into the production wells.

Applying SFOD to depleted CHOPS reservoirs will extend the life of the field, resulting in an increase in oil recovery. For optimal advantage, certain geological and reservoir conditions can dictate which formations are candidates for underburden thermal stimulation. Ideally the lower zone is a second oil formation capable of supporting a thermal EOR project and which happens to be separated from the first oil formation of the upper zone by a low to non-permeable layer or caprock. The target zone is one suitable for supporting a foamy oil drive.

Figure 4:
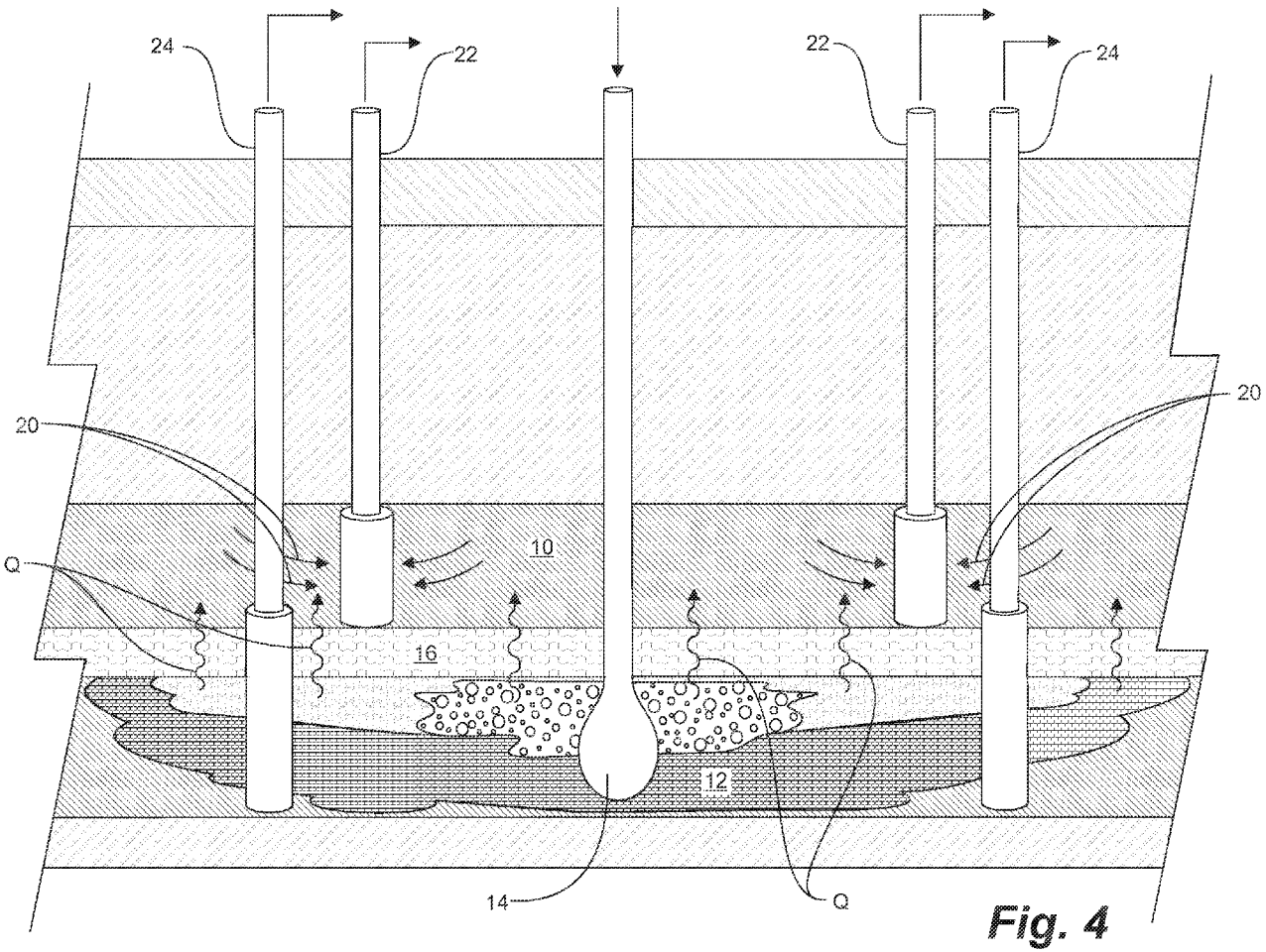
FIG. 4 is a schematic illustration of a thermal process in an underburden zone, for transfer of thermal energy from that process to be received at an upper hydrocarbon zone for Thermal EOR.

Having reference to FIG. 4, one can see a general embodiment utilizing underburden heat for thermal stimulation of an overlying target formation. This overlying or upper zone 10 contains a first heavy oil formation suitable for CHOPS production which overlies a lower zone 12. Heat is provided to the lower zone 12 from a thermal source 14, such as using steam injection from a steam injection well, in-situ-steam generation or using a greater energy source such as that from operating a downhole burner for hot combustion gas and steam formation. One form of downhole burner is set forth in PCT publication WO 2010/081239, published Jul. 22, 2010, for the production of steam and combustion gases. Particularly, where the upper zone 10 is isolated from the lower zone 12 by a substantially non-permeable strata or layer 16, thermal energy Q from the process occurring in the lower zone 12, is transferred upwardly through conduction, in this case into the upper zone 10. Heavy oil 20 in the upper zone 10 is mobilized, such as through SFOD, and produced at production wells 22 completed into the upper zone 10. In the lower zone 12, water or emulsion can be removed as necessary using recovery wells 24 completed in the lower zone 12 and at locations spaced laterally from the thermal source 14.

Figure 5:
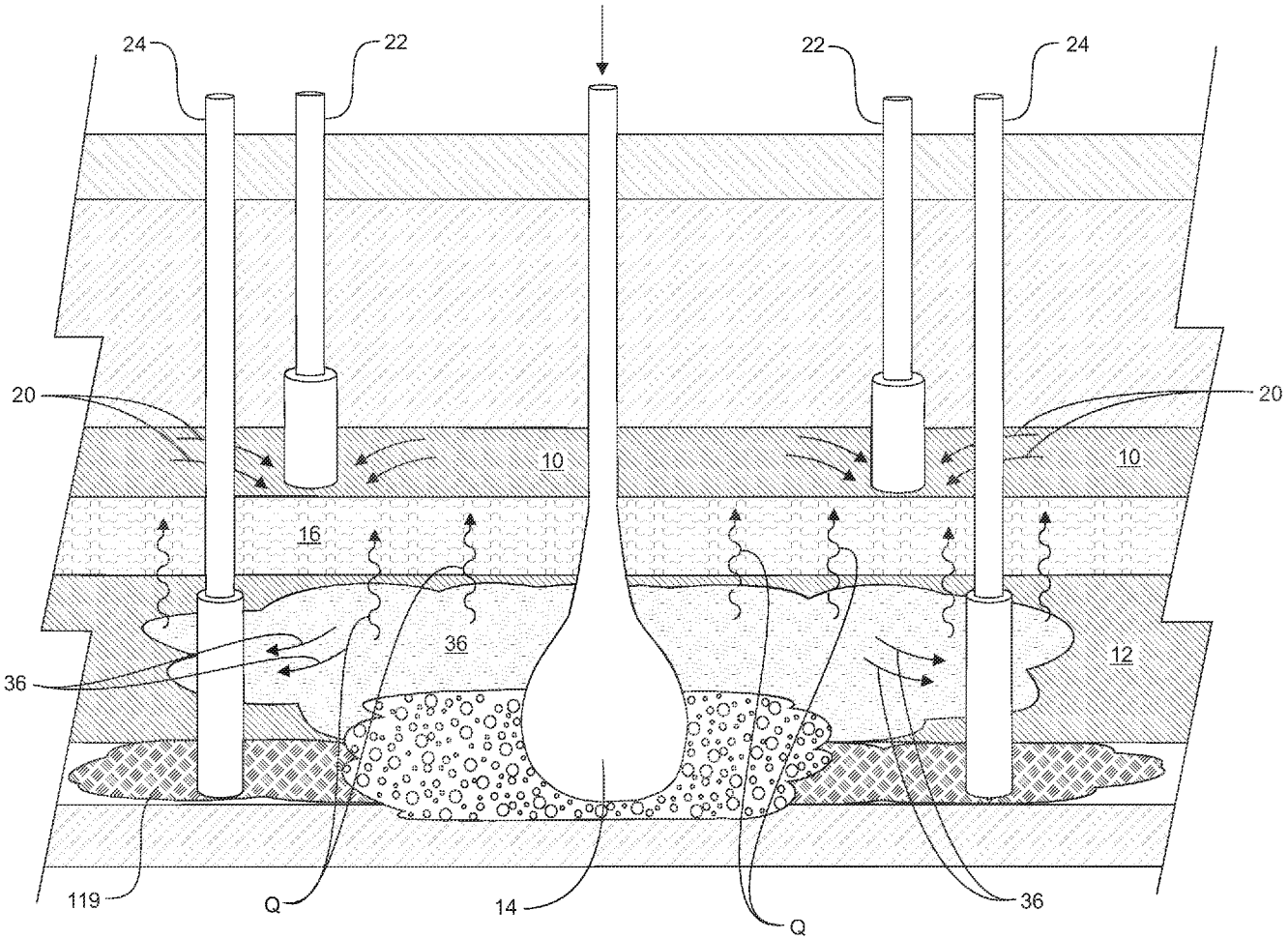
FIG. 5 is a schematic illustration of a thermal EOR in a lower hydrocarbon zone and thermal energy of that process received at an upper hydrocarbon zone for thermal EOR.

Having reference to FIG. 5, one can see another embodiment utilizing underburden heat for a first thermal stimulation of an overlying target or upper zone 10, while performing a second thermal stimulation in a lower zone 12. A first oil formation in an upper zone 10 overlies a second oil formation in the lower zone 12. Heat is provided to the lower zone 12, in this instance also being a hydrocarbon zone receiving thermal stimulation. In this embodiment, heat can be provided via a SAGD arrangement having at least a steam injection well and a producer well for thermal stimulation and production from that lower zone 12. The lower zone 12 may be appropriate for SAGD including having sufficient thickness and geology. If not appropriate, such as being deemed too thin or shallow to accept conventional SAGD injection and producer wells due to minimum spacing requirements and the like, then such concerns are alleviated using a thermal source 14 such as steam injection, in-situ-steam generation or using a greater energy source such as that from a downhole burner. One form of downhole burner is set forth in PCT publication WO2010/081239, published Jul. 22, 2010 to Schneider et al. A thermal source 14, in the form of a steam injector can be a vertical or horizontal steam injector or one or more horizontal in-situ steam generators which traverse the zone coupled with one or more vertical or horizontal producers 24 arranged for collection of mobilized oil from the lower zone 12. Regardless of the means for thermal-enhanced oil recovery in the lower zone, the thermal energy Q, which would otherwise be lost, is now recovered by a heating of the upper zone 10, in this case the upper heavy oil zone.

Thermal energy from the process occurring in the lower zone 12 is transferred by conduction, through the substantially non-permeable layer 16, and into the overlying, heavy oil upper zone 10. Heavy oil 20 in the upper zone 10 is mobilized and produced therefrom. Mobilized oil, water, oil or emulsion can be removed as necessary using the producers or recovery wells 24 completed in the lower zone 12, spaced from the thermal source 14.

Figure 6B:
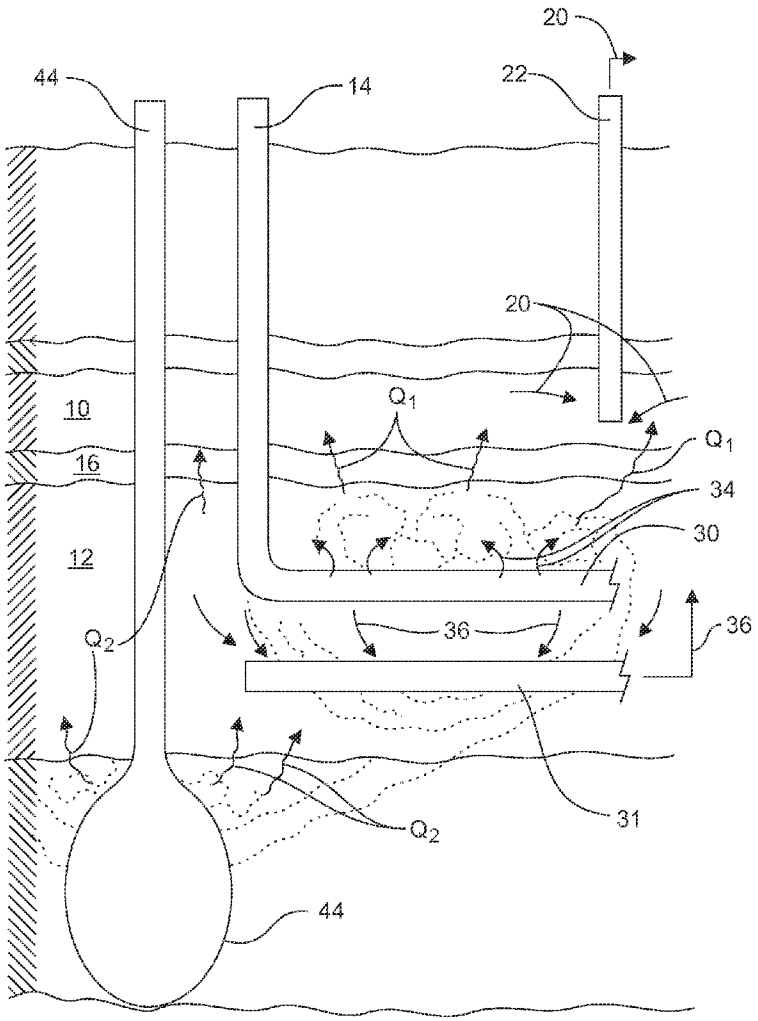
FIG. 6B is a schematic illustration of another thermal process conducted in a first underburden zone underlying a second and lower hydrocarbon zone, a second thermal process for thermal EOR, and a third and overlying upper hydrocarbon zone for thermal EOR.
Figure 6A:
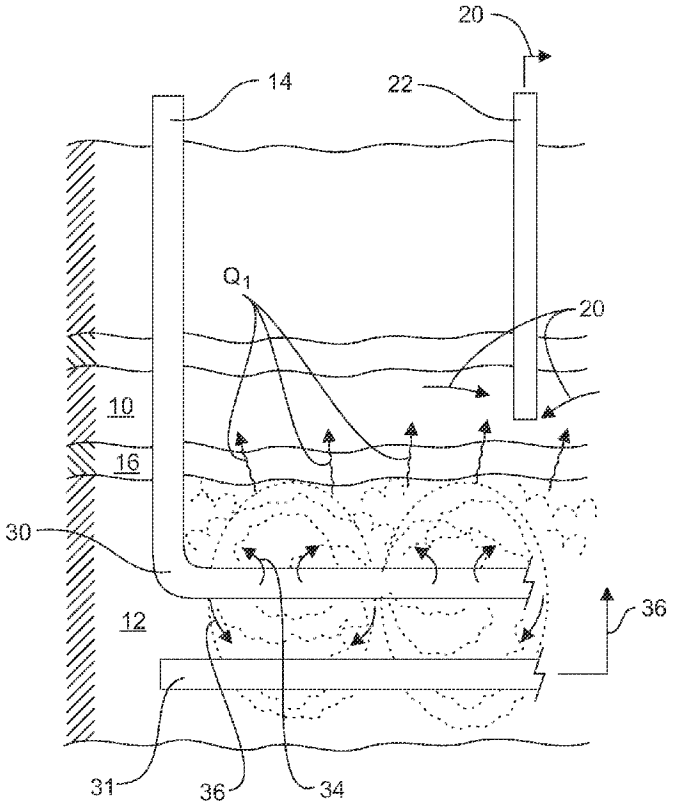
FIG. 6A is a schematic illustration of another embodiment having a steam EOR, such as SAGD, in a lower hydrocarbon zone and thermal energy of that SAGD received at an upper hydrocarbon zone for thermal EOR.

Having reference to FIG. 6A one can see several other embodiments including a general embodiment, similar to that of FIG. 5, in which a thermal source 14 such as SAGD, via a horizontal steam injection well 30 stimulates thermal mobilization of oil 36 for recovery by a horizontal producer well 31, both of which are completed in the lower zone 12. Steam 34 from the thermal source 14 or injection well 30 provides heat Q1 to the upper zone 10 for mobilizing oil 20 for collection at the horizontal producer well 31. The residual waste heat or thermal energy Q1 is conducted upwardly for secondary stimulation of heavy oil 20 in the upper zone 10.

Having reference to FIG. 6B one can see that several zones can be stimulated using a variety of combinations of thermal sources in underlying zones. As shown in FIG. 6B, a first and deepest source 44 of thermal energy Q2 is a downhole burner and steam generation process such as that detailed in WO 2010/081239 to Schneider et al. Heat Q2 from that deepest process is received by a second, overlying lower zone 12. The heat Q2 received by the lower zone 12 is supplemented by a second source 14 of thermal energy Q1, such as a steam EOR process, located in the lower zone 12. A steam EOR process can include SAGD having horizontal injection well 30 and horizontal producer well 31. The thermal energy Q1 from the second thermal source 14 and residual heat Q2 from the first thermal source 44 are received by a third, upper zone 10 for thermal EOR.

Basal Water Zones

As shown in FIG. 1, in another embodiment, an oil formation or upper zone 110 overlies and is in communication with an underlying zone containing basal water 112 such as an underlying base or basal water zone 113, characteristic of some areas in Alberta, Canada.

Heavy oil formations benefit most from the embodiments disclosed herein including forms of oil typically recovered using the thermal methods and non-thermal methods described above. The basal water zone 113 is accessed and means are completed for introducing hot non-condensable gases into the water zone. The term non-condensable means the gases are non-condensable at the formation conditions. The term "introducing" includes injecting at a point, such as an injection well 114, into the formation or generation at a point in the formation, such as at a downhole tool 115 situated in the formation. The non-condensable gases can be hot gases which include products of combustion, such as carbon dioxide $CO_2$ which are introduced hot or are formed downhole, such as by a downhole combustor. The pressure injection (Pinj) will be greater than the pressure in the basal water zone (Pbw) and the pressure Pbw in basal water zone 113 will be greater than the pressure in the heavy oil formation Poil. Pressure management can assist with the drive and avoiding gravity drainage of mobilized oil.

Mobility of the heavy oil 120 is poor at initial, in-situ temperature conditions. According, the heavy oil 120 initially forms a low permeability barrier, and hot gases 117, injected into the basal water zone 113, displace the water 112 radially and laterally from the point of introduction, such as the injection well 114, creating a bowl-like interface or inverted cone of rising hot gases 117. The hot gases 117 impart sufficient energy to create steam 116, either from the water 112 in the water zone 113 or injected water. Water is introduced for mixing with the hot gases, or connate water or basal water is heated by the hot gases, creating steam 116. The steam 116 and the hot gases 117 flow out into the basal water zone 113.

Where the hot gas is $CO_2$, the density of the hot gas, at the same downhole pressure and temperature conditions, is several times greater than the density of the steam. Further, the mobility of hot $CO_2$ through the reservoir is less than the steam. Accordingly, the steam 116 tends to gravity separate from the hot gas 117 or $CO_2$ and stratify, the heavier $CO_2$ migrating downward and steam migrating upward. The $CO_2$ forms an insulating layer 119 between the basal water 112 and the steam 116.

Thus the steam 116 rises to contact the overlying heavy oil bearing zone 110, transferring thermal energy Q, as a result of the water's latent heat of vaporization, preferentially to this overlying upper zone 110 as the steam condenses and accordingly heat loss to the basal water 112 is minimized. As steam condenses to water, the water's greater density causes it to percolate down through the $CO_2$ layer and join or mix in with the basal water 112.

Thus transfer of thermal energy Q is maximized to the overlying heavy oil formation 110 and heat loss is minimized to the heat sink of the basal water 112 in the basal water zone 113. In contradistinction, in the prior art PCSD and conventional steam flood processes, introduced heat is designed to flow to the basal water.

Figure 2:
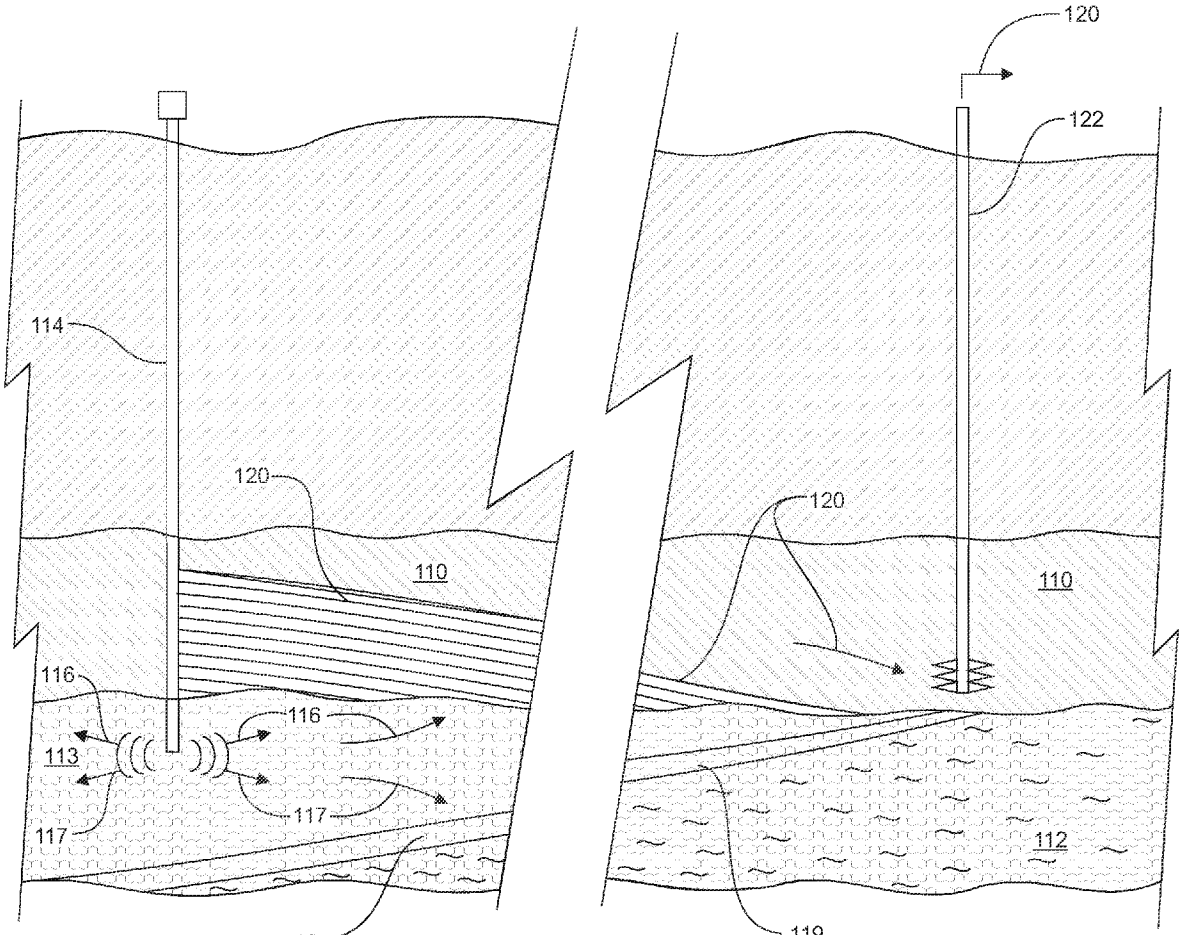
FIG. 2 illustrates a thermal injection well in a lower water zone, development of a gas/water insulating layer and optimized thermal stimulation and mobilization.

As shown in FIG. 2, the mobilized oil 120 is displaced in a steam or gas drive towards the production wells 122.

At original formation conditions the heavy oil can be very viscous, having a viscosity up to the hundreds of thousands of centipoise (cp), being intractable and immobile and unrecoverable using conventional means. In comparison, water has viscosity less than 1 cp. Using a steam 116 and hot gas 117 layer embodiment, having an insulating layer 119, heat Q is now effectively transferred to the heavy oil formation of the upper zone 110. At steam condensation temperatures, the heavy oil viscosity can drop many orders of magnitude and into the hundreds or tens of centipoise, being recoverable using known production well techniques. As heavy oil mobility in the heavy oil formation increases, steam continues to be effectively directed higher and to ever greater radial extent in the heavy oil formation.

As shown in FIG. 2, one or more production wells 122, or an array of production wells 122, recover mobilized heavy oil 120 from locations in the upper zone 110 spaced laterally from the injection well 114 completed in the lower zone 113. A variety of production scenarios are possible and which can vary over the life of the mobilization.

Figures 3A, 3B, 3C:
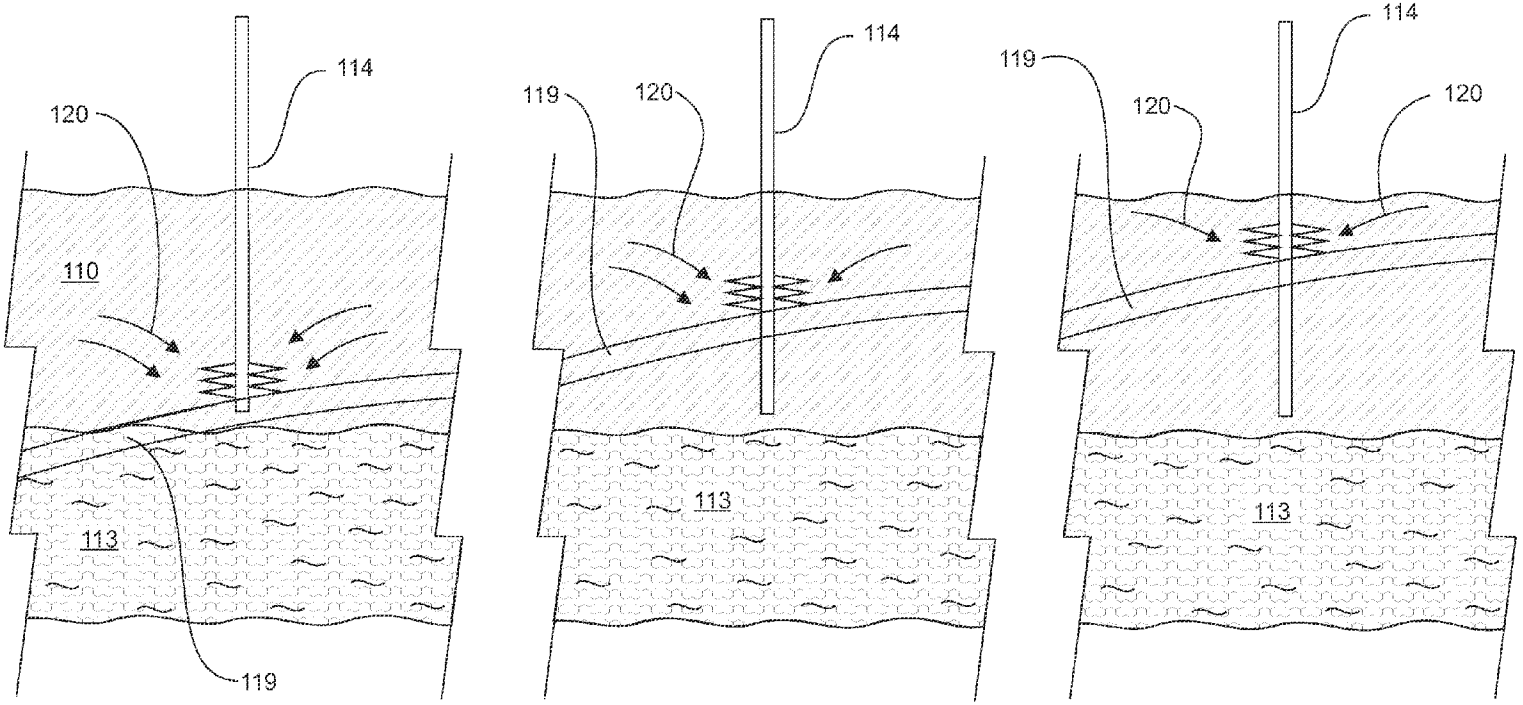
FIGS. 3A through 3C illustrate various completions over time, or different spacing, for optimal recovery of mobilized oil.

As shown in FIGS. 3A, 3B and 3C, and in one embodiment, the production well or wells are completed in the heavy oil formation or upper zone 110. As water can be more than 100 times more mobile than the oil, and there is effectively an infinite reserve of water, one would typically avoid completion in the basal water zone 113 to avoid a high water fraction in the produced fluid and, further, one would complete high enough in the heavy oil formation to avoid water-coning.

In one embodiment, one can track wellbore temperature and complete or perforate the production well 122 to place perforations 130 in the oil formation according to an oil mobility or thermal profile. The well 122 can be re-completed (FIG. 3B, 3C) to place perforations 130 higher in the well 122 as the thermal profile changes over time. Alternate means for sensing a change in oil mobility adjacent the production well 122 includes neutron logs or measuring gas effect.

In another embodiment, one would perforate high in the oil zone 110 and rely on bottom water drive to push the mobilized oil up to the production well 122. In another scenario, one might perforate in the middle of the oil zone 110 and rely on a horizontal pressure gradient to push the oil to the production well. And in another scenario, one could operate the hot gas and steam generator injector cyclically. After injection stops, all of the steam will eventually condense and the $CO_2$ migrates to the top of the oil zone forming a gas cap. In this case one could then perforate low in the oil zone 110 and rely on the gas cap to drive the oil to the production well. Any of the scenarios could be used at different stages of the formation or reservoir depletion.

The injection well 114 can inject hot gas, of hot gas and water as water or as steam, or constituents which result in the production of hot gas and steam.

One method and apparatus for downhole production of heat in the form of steam and hot combustion gases (primarily CO, $CO_2$, and $H_2O$) is set forth in Applicant's co-pending patent application for apparatus and methods for downhole steam generation and enhanced oil recovery (EOR). The downhole steam generator was filed Jan. 14, 2010 in Canada as serial number 2,690,105 and in the United States published Jul. 22, 2010 as US 2010/0181069 A1, the entirety of both of which are incorporated herein by reference.

In Applicant's co-pending downhole steam generation and EOR, a downhole burner assembly is fluidly connected to a main tubing string, and is positioned within a target zone. The burner assembly creates a combustion cavity by combusting fuel and an oxidant at a temperature sufficient to melt the reservoir or otherwise create a cavity. The burner assembly then continues steady state combustion to create and sustain hot combustion gases for flowing and permeating into the target zone for creating a gaseous drive front. Water is injected into the target zone, uphole of the combustion cavity for creating a steam drive front. Therein, the burner assembly could be positioned within a cased wellbore at the target zone, the burner assembly having a high temperature casing seal adapted for sealing a casing annulus between the downhole burner and the cased wellbore, and a means for injecting water into the target zone above the casing seal. The high temperature casing seal can pass through casing distortions, and is reusable, not being affected substantially by thermal cycling.

A combustion chamber can be formed operating the burner assembly at a temperature sufficient enough to melt the formation of the target zone. Thereafter, steady state combustion is maintained for sustaining a sub-stoichiometric combustion of the fuel and oxygen for producing hot combustion gases (primarily CO, $CO_2$, and $H_2O$) which enter and permeate through the target zone. The hot combustion gases create a gaseous drive front and heat the target zone adjacent the combustion cavity and the wellbore. Addition of water to the target zone along the casing annulus above the combustion chamber injects water into an upper portion of the target zone adjacent the wellbore for lateral permeation therethrough. The lateral movement of the injected water cools the wellbore from the heat of the hot combustion gases and minimizes heat loss to the formation adjacent the wellbore. The water further laterally permeates through the target zone and converts into steam. The steam and the hot combustion gases in the target zone form a steam and gaseous drive front.

Applied in the context of the basal water displacement scenario, and in an embodiment of the present invention, the use of a downhole burner and in-situ generation of steam meets both objectives of producing a hot gas, containing $CO_2$, and generation of steam 116, either through reaction of the energy from the downhole burner and the basal water or the reaction of the energy from the downhole burner and added water. One can anticipate employing the addition of water, such as through the casing annulus, once the basal water is further and further displaced from the injection well.

In another embodiment, also represented graphically by FIG. 1, a first oil formation in an upper zone 110 overlies a non-hydrocarbon-bearing, underburden or other lower zone such as basal water zone 113. The lower zone is accessed and means 114 are completed for introducing non-condensable gases 117 into the lower zone. Again, the term "non-condensable" means the gases are non-condensable at the formation conditions. The non-condensable gas also has a higher density than that of the steam. The non-condensable gases can include products of combustion, such as carbon dioxide $CO_2$ which are introduced hot or are formed downhole, such as by a downhole combustor. The non-condensable gas 117 can also be other available gas such as nitrogen ($N_2$). Carbon Dioxide and $N_2$ are heavier than steam 116 and will pool or form an insulating bubble or layer 119 below the injected steam 116. For example, where the heavier gas is $CO_2$, the density of the gas, even at hot conditions such as combustion, steam generation or injection, are several times greater than the density of the steam. Further, the mobility of $CO_2$ through the formation is less than the steam.

Accordingly, the steam 116 tends to separate from the $CO_2$, the heavier CO2 migrating downward and steam migrating upward. The $CO_2$ forms an insulating bubble or layer between the underlying zone and the steam thereabove. Thus the steam 116 rises to contact the overlying heavy oil bearing zone 110, transferring the water's latent heat Q of vaporization to this zone as the steam 116 condenses and heat loss to the underlying zone 113 or basal water 112 is minimized. As the water from the steam/heavy oil interface condenses, its greater density causes it to percolate down through the $CO_2$ layer to the lower zone and, in the case of a basal water zone 113, to join or mix in with the basal water 112.

Advantageously, industrially-produced $CO_2$, such as that earmarked for carbon capture, storage or sequestration can be injected from surface for forming the gas bubble or insulating layer 119 at the lower layer and buoying steam 116 thereabove for heat transfer Q to the overlying zone 110.

The embodiments of the invention for which an exclusive property or privilege is claimed are defined as follows:

1. A method of thermal oil recovery of oil from an oil formation comprising:

introducing gas and steam into a lower zone having a basal water zone and underlying an upper zone containing a first oil formation, the gas and steam introducing thermal energy to the lower zone, the gas having a density greater than that of the steam;

gravity separating at least some of the gas from the steam for forming an insulative later of gas between the steam and the basal water zone for transferring the thermal energy upwardly;

receiving the thermal energy at the upper zone from the lower zone; and using the thermal energy for thermally mobilizing the oil of the first oil formation for recovery at one or more production wells completed in the upper zone and spaced laterally from the location of introduction of the thermal energy.

2. The method of claim 1 wherein introducing thermal energy into the lower zone comprises operating a downhole burner for the production of steam and combustion gases.

3. The method of claim 1 wherein introducing thermal energy into the lower zone comprises generating in-situ steam.

4. The method of claim 1 wherein the upper zone is isolated from the lower zone by a substantially non-permeable layer.

5. The method of claim 4 wherein the lower zone is a second oil formation.

6. The method of claim 5 wherein the introducing of steam to the lower zone further comprises:

providing a steam assisted gravity drainage (SAGD) arrangement in the lower zone, the SAGD arrangement having at least a steam injection well and at least a producer well; and introducing steam from the at least a steam injection well;

thermally mobilizing the oil in the second oil formation;

recovering oil from the second oil formation at the at least a producer well; and whereby receiving the thermal energy at the upper zone further comprises receiving residual thermal energy from the lower zone.

7. A method of thermal oil recovery of oil from an oil formation comprising:

introducing gas and steam to a lower zone underlying the oil formation for introducing thermal energy to the lower zone, the gas having a density greater than that of steam;

gravity separating at least some of the gas from the steam for forming an insulating layer of gas below the steam and transferring the thermal energy upwardly; and thermally mobilizing the oil for recovery at one or more production wells spaced laterally from the point of introduction.

8. The method of claim 7 wherein the oil formation overlies basal water, and wherein the gravity separating at least some of the gas from the steam forms the insulating layer between the steam and the basal water.

9. The method of claim 8 further comprising draining water from condensed steam into the basal water.

10. The method of claim 8 further comprising displacing the basal water for forming an inverted cone of gas and steam which is insulated from the basal water.

11. The method of claim 7 further comprising displacing the thermally mobilized oil for recovery at the one or more production wells.

12. The method of claim 11 wherein the introducing of the gas and steam displaces the thermally mobilized oil.

* * * * *